United States Patent [19]

LaMonte

[11] 4,332,051

[45] Jun. 1, 1982

[54] ATTACHMENT TOOL FOR A VACUUM CLEANER HOSE

[76] Inventor: Salvatore LaMonte, 920 Ward Ave., #8F, Honolulu, Hi. 96814

[21] Appl. No.: 194,672

[22] Filed: Oct. 6, 1980

[51] Int. Cl.[3] ..... A47L 9/06

[52] U.S. Cl. ..... 15/328; 15/398; 15/416

[58] Field of Search ..... 15/307, 394, 398, 399, 15/400, 415 R, 415 A, 416, 417

[56] References Cited

U.S. PATENT DOCUMENTS

| | | | |
|---|---|---|---|
| 986,245 | 3/1911 | Thurman | 15/416 X |
| 2,101,222 | 12/1937 | McCracken | 15/398 |
| 2,811,738 | 11/1957 | Gall | 15/418 X |
| 2,953,808 | 9/1960 | Carmack | 15/416 X |

FOREIGN PATENT DOCUMENTS

| | | | |
|---|---|---|---|
| 511102 | 3/1955 | Canada | 15/400 |

*Primary Examiner*—Chris K. Moore

*Attorney, Agent, or Firm*—Schapp and Hatch

[57] ABSTRACT

An attachment tool for a vacuum cleaner hose is disclosed taking the form of an elongated flattened tubular housing; one end being adapted to connect to a vacuum cleaner hose, and the other end terminating in a flattened air intake opening. One flat face of the housing has an elongated opening therein adjacent the other end of the housing; the elongated opening having a means for selectively covering it. A pair of elongated strip brushes extend along opposite sides of the elongated opening.

10 Claims, 4 Drawing Figures

ATTACHMENT TOOL FOR A VACUUM CLEANER HOSE

BACKGROUND OF THE INVENTION

1. Field of the Invention

The present invention relates to an attachment for a vacuum cleaner hose, and more particularly to a combination tool or appliance adapted to be affixed to the end of a hose connected to a vacuum cleaner for cleaning inaccessible areas.

2. Description of the Prior Art

Elongated "crevice" tools are well known in the vacuum cleaner art. The working ends of these crevice tools are long and flat for insertion into crevices such as those found between the cushions and the surrounding portions of chairs or sofas. The flattened end of the tool is usually cut off at an angle to facilitate picking up of material from carpets adjacent to walls.

It has herefore been proposed to provide a crevice tool with a brush capable of loosening materials so they may be more readily picked up by the tool. For example, see U.S. Pat. No. 2,679,068 to J. P. Weid. While the brushes of Weid improve performance by loosening dirt, dust, etc., the location and positioning of the bristles interfere with use of the device as a crevice tool, necessitating removal of the brush in order to perform the ordinary crevice tool operations.

Another typical approach to providing a crevice tool with a brush is illustrated in U.S. Pat. No. 2,811,738 to Francis A. Gall. Gall provides a circular brush which may be clipped on to the crevice tool to convert it into a tool for cleaning radiators, Gall providing a plurality of orifices on one face of the tool which may be opened by retracting a cover plate when the device is to be used as a radiator brush tool.

U.S. Pat. No. 2,101,222 to L. O. McCracken shows a vacuum cleaner hose attachment of elongated flattened form utilized for removing dust and other foreign matter from under low set pieces of furniture.

SUMMARY OF THE INVENTION

The novel construction of the present invention provides several advantages over the prior crevice tool constructions. Applicant's multi-purpose tool is adapted for use both as a crevice tool in the conventional manner, and as a tool for cleaning between relatively inaccessible surfaces, such as between the slats of a venetian blind. Conversion of the tool from one use to the other is accomplished merely by advancing or retracting a sliding panel forming part of the device. No addition or removal of brushes is required while effecting such conversion. Thus, the tool of the present invention is self contained and requires no separate parts or pieces.

When operating to clean venetian blinds and the like, withdrawal of the sliding panel uncovers an elongated opening. Because the opening is of larger area than the end opening of the tool, and because of the tapering shape of the tool becoming more and more flattened toward the end port, thus reducing the effective cross sectional area of the duct, air will be drawn in through the elongated opening.

Strip brushes of low height are arrayed along both sides of the elongated opening and serve to dislodge dust, etc. from venetian blind slats and the like. These brushes are particularly suited for cleaning venetian blinds and are composed of a mixture of nylon and boar's hair bristles. The described arrangement of the strip brushes on both sides of elongated opening increases surface cleaning space over existing devices, resulting in a much more effective cleaning action. Instant conversion back to crevice cleaning mode is readily accomplished by merely sliding the panel to its covering position.

It is therefore an object of the present invention to provide an attachment tool for a vacuum cleaner hose which provides the advantages of both a crevice cleaning tool and a greatly improved tool for cleaning between venetian blind slats in a single unitary device.

Another object of the present invention is to provide an attachment tool of the character described which is readily and instantly convertible from crevice tool mode to venetian blind mode without requiring attachment or detachment of parts.

A further object of the present invention is to provide an attachment tool of the character set forth which may be operated with facility in either mode, which is simple and sturdy in construction, and which provides for ready replacement of the strip brushes, when worn.

A still further object of the present invention is to provide a multi-purpose attachment tool of the character described which is useful for accomplishing easier and more efficient dust removal from the tops of books in bookshelves and similar areas of limited insertion space.

For a fuller understanding of the nature, and further objects and features of advantage of the present invention, reference should be had to the following detailed description, taking in connection with the accompanying drawings and the appended claims.

Figure 3:
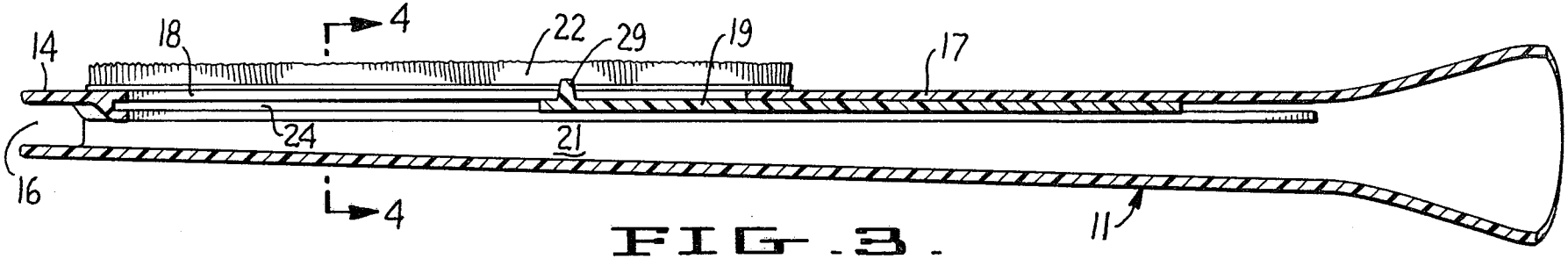
FIG. 3 is longitudinal vertical cross-sectional view taken substantially on the plane of line 3—3 of FIG. 2.

While only the preferred embodiment of the invention has been illustrated in the drawings, it will be apparent as the specification progresses that certain modifications could be made to the illustrated structure within the ambit of the claims.

DESCRIPTION OF THE PREFERRED EMBODIMENTS

Referring now to the drawings in detail, it will be seen that the attachment tool for a vacuum cleaner hose of the present invention basically includes an elongated flattened tubular housing 11 having an end 12 adapted for connection to a vacuum cleaner hose 13 and an opposite end 14 providing a flattened air intake opening 16, one flattened face 17 of said housing being formed to provide a single elongated opening 18 therethrough extending centrally of the face 17 adjacent to the end 14, together with means 19 on the housing 11 formed for selectively covering opening 18 for admitting air therethrough to the interior 21 of the housing, and a pair of elongated strip brushes 22 and 23 carried on the flattened face 17 of the housing 11 and extending along opposite side of the elongated opening 18.

As may best be seen in FIG. 3 of the drawings, the housing 11 tapers as it flattens out to become thinner approaching end 14 whereby the cross-sectional area of the interior 21 of the housing diminishes along its length toward end 14. The tapering of the housing 11, as illustrated in the drawings, provides the flattened face 17 in which the opening 18 is formed. The means 19 for selectively covering the opening 18 here consists of a flattened, elongated rectangular panel mounted on the housing 11 for endwise movement between a closed position fully covering the elongated opening 18 and an open position uncovering the elongated opening, the sliding panel 19 being shown in an intermediate, partially opened position in the drawings.

As here shown, the housing 11 is formed with confronting grooves 24 and 26 running along the longer opposite sides 27 and 28 of opening 18, the longer side edges of the panel 19 being slidably mounted in the grooves 24 and 26. An upwardly extending tab 29 is formed on the upper side of panel 19 for manual engagement to facilitate sliding of the panel between its open and closed positions.

Figure 2:
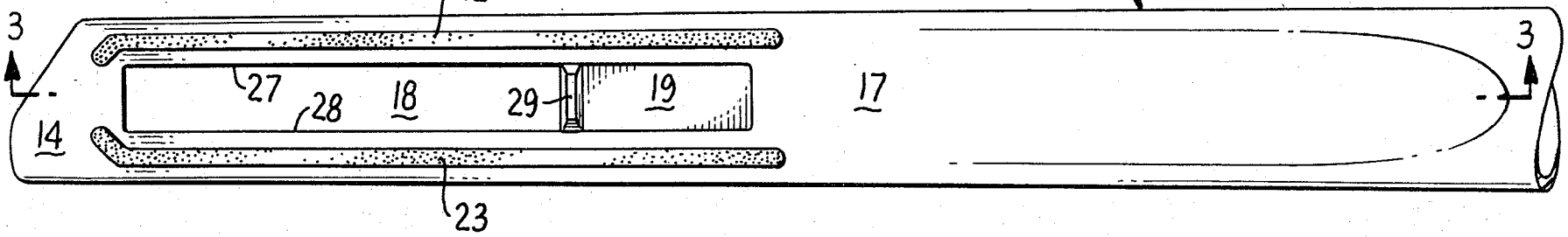
FIG. 2 is a plan view of the attachment tool of FIG. 1.
Figure 1:
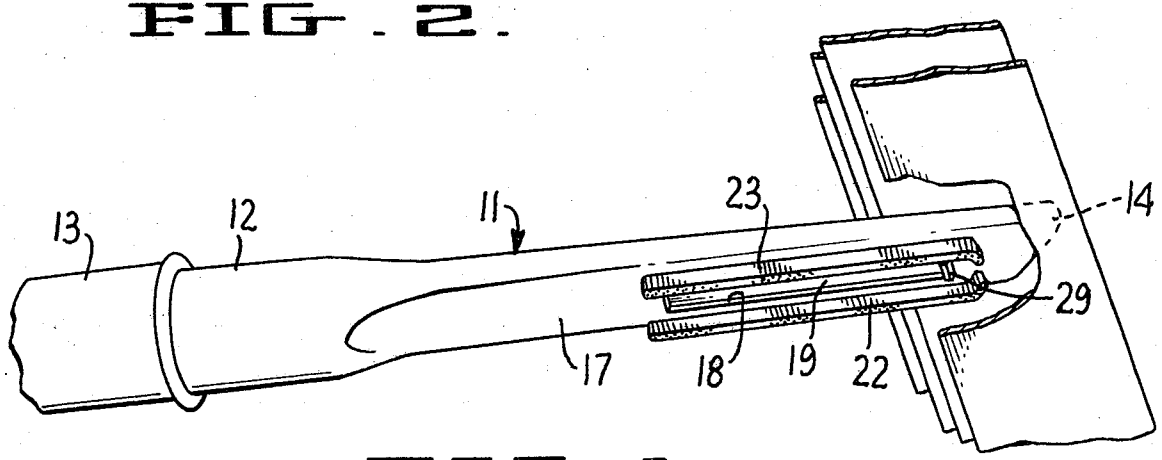
FIG. 1 is a perspective view of an attachment tool constructed in accordance with the present invention and illustrated in position for cleaning between slats of a venetian blind.
Figure 4:
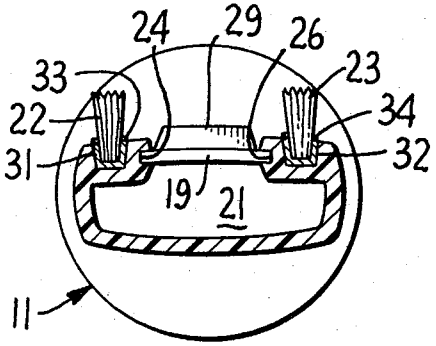
FIG. 4 is a vertical cross-sectional view taken substantially on the plane of line 4—4 of FIG. 3.

Preferably, as here shown, the housing 11 and sliding panel 19 are of molded plastic and the elongated strip brushes 22 and 23 are mounted in slots 31 and 32 formed in housing 11 along the opposite longer sides 27 and 28 of the opening 18, outboard of the grooves 24 and 26, see FIG. 4. The strip brushes extend slightly beyond the ends of the elongated opening 18 and preferably are curved inwardly toward each other at the ends of the brushes adjacent to housing end 14, see FIG. 2.

The described configuration markedly facilitates the cleaning action of the tool when used between closely set surfaces such as slats of venetian blinds, between the tops of books and the shelf above, between and behind air conditioning and refrigeration units along side walls, between the slats of window shutters, louvers and between the glass strips of jalousie windows, etc. The multi-purpose tool of the present invention is extremely versatile with regard to the places which may be cleaned and the adaptability of the tool to various modes of cleaning. The tool may be readily converted to crevice cleaning mode merely by sliding panel 19 to close opening 18, and may be readily converted to its mode for cleaning between closely spaced surfaces by merely sliding panel 19 to open position.

In accordance with the present invention, the strip brushes 23 have short, fixed bristles provided in a combination or mixture of natural boar's hair and nylon. The combination of boar's hair and nylon increases both the flexibility and durability of the brushes. The flexibility of the boar's hair bristles allows and for relatively delicate cleaning and the stiffness of the nylon bristles, together with the low height of the bristles, provides sturdiness in cleaning caked-on dirt. The location of the bristles closer to the end 14 of the tool provides an increase in the cleaning area for more effective disturbing and removal of dust particles. The location of the brush bristles along the sides of the opening 18 directs the air flow in an efficient manner not found in prior crevice tools.

As here shown, the strip brushes 22 and 23 have rows of bristles of the type described held in brush form by metal backing strips or clips 33 and 34, with these clips being insertable into the grooves 31 and 32. Preferably, the grooves 31 and 32 are formed to retain the clips 33 and 34 in place by the spring pressure afforded by the metal of the clips, thus permitting easy removal and replacement of the brushes when worn. For the best accomplishment of the purposes of the tool the bristles should project about one quarter inch from the housing, and the housing should be about one and three sixteen inches wide by about three eighths inch thick at the end 14.

From the foregoing, it will be seen that the attachment tool of the present invention provides a novel and readily convertible multi-purpose tool capable of use both as a crevice tool and as a tool for the cleaning between closely positioned surfaces such as the slats of venetian blinds, etc.

I claim:

1. An attachment tool for a vacuum cleaner hose, comprising an elongated flattened tubular housing having an end adapted for connection to a vacuum cleaner hose and an opposite end providing a flattened air intake opening, one flattened face of said housing being formed to provide a single elongated opening therethrough extending centrally of said face adjacent to said opposite end, means on said housing formed for selectively covering said elongated opening for admitting air therethrough to the interior of said housing, and a pair of elongated strip brushes carried on said flattened face of said housing and extending along opposite sides of said elongated opening.

2. An attachment tool as described in claim 1, and wherein said elongated flattened tubular housing tapers to become thinner approaching said opposite end whereby the cross sectional area of the interior of said housing diminishes along its length toward said opposite end.

3. An attachment tool as described in claim 1, and wherein said means for selectively covering said elongated opening comprises a flattened elongated rectangular panel mounted on said housing for endwise movement between a closed position fully covering said elongated opening and an open position uncovering said elongated opening.

4. An attachment tool as described in claim 3, and wherein said housing is formed with confronting grooves running along the longer opposite sides of said opening, and the longer side edges of said panel are slidably mounted in said grooves.

5. An attachment tool as described in claim 4, and wherein said housing and said panel are of molded plastic, and said elongated strip brushes are mounted in slots formed in said housing along the opposite longer sides of said opening outboard of said grooves.

6. An attachment tool as described in claim 5, and wherein said strip brushes are formed with a row of short bristles projecting from an elongated U-shaped metal strip, and said metal strips are removably snapped into said slots in said housing.

7. An attachment tool as described in claim 1, and wherein said strip brushes are each formed with a row composed of short nylon and boar's hair bristles held in a U-shaped elongated metal strip, and said strip is removably secured to said housing alongside the longer opposite sides of said elongated opening.

8. An attachment tool as described in claim 7, and wherein the ends of said strip brushes adjacent to said opposite end of said housing extend past said elongated opening and curve inwardly toward each other thereat.

9. An attachment tool for a vacuum cleaner hose, comprising an elongated hollow housing having a cylindrical open end formed for releasable attachment to a vacuum cleaner hose, said housing tapering and flattening from said cylindrical open end to an opposite end providing a flattened intake port for cleaning crevices, said housing being formed to provide an elongated intake opening adjacent to said opposite end, an elongated closure member slidably mounted on said housing for selective movement between advanced and retracted positions covering and uncovering said elongated intake opening, and first and second strip brushes mounted on said housing alongside the longer opposite sides of said elongated opening, said strip brushes having bristles projecting away from said housing a minimal distance whereby with said closure member in said retracted position said tool is insertable between slats of a venetian blind.

10. An attachment tool as described in claim 9 and wherein said bristles project about $\frac{1}{4}$ inch from said housing, and said housing is about 1-3/16 inches wide and about $\frac{3}{8}$ inch thick at said opposite end.

* * * * *